US007533480B2

(12) United States Patent
Chao et al.

(10) Patent No.: US 7,533,480 B2
(45) Date of Patent: May 19, 2009

(54) BICYCLE SHOE SOLE HAVING COUPLING MEMBER

(76) Inventors: Kuo Chih Chao, No. 51, Hengjun Street, Dagia Town, 43743 Taichung Hsien (TW); Chia Pin Chen, No. 51, Heng Street, Dagia Town, 43743 Taichung Hsien (TW)

( * ) Notice: Subject to any disclaimer, the term of this patent is extended or adjusted under 35 U.S.C. 154(b) by 566 days.

(21) Appl. No.: 11/186,683

(22) Filed: Jul. 21, 2005

(65) Prior Publication Data

US 2007/0017127 A1 Jan. 25, 2007

(51) Int. Cl.
*A43B 5/00* (2006.01)

(52) U.S. Cl. ..... 36/131; 36/132; 74/594.6

(58) Field of Classification Search ..... 36/131, 36/132, 59 C; 74/594.6, 594.4
See application file for complete search history.

(56) References Cited

U.S. PATENT DOCUMENTS 550,409 A 11/1895 Hanson
4,876,808 A 10/1989 Hsieh ..... 36/131
4,907,355 A * 3/1990 Allen et al. ..... 36/131
5,007,185 A * 4/1991 Lazarski ..... 36/135
5,125,173 A * 6/1992 Nagano et al. ..... 36/131
5,284,066 A * 2/1994 Weiss ..... 74/594.6
5,704,256 A * 1/1998 De Lattre ..... 74/594.6
2002/0194951 A1* 12/2002 Lowe ..... 74/594.6

* cited by examiner

*Primary Examiner*—Jila M Mohandesi

(57) ABSTRACT

A bicycle shoe sole includes a bottom portion having a number of projections extended downwardly from an outer peripheral portion and having a middle portion having no projections, and having a stud extended downwardly from the middle portion. A coupling member is integrally formed on the stud, without fasteners, by such as molding or mold injection processes, to allow the coupling member to be solidly disposed and attached on the bicycle shoe sole, and to prevent the coupling member from being disengaged from the bicycle shoe sole. The coupling member includes a front protrusion and a rear protrusion for coupling the shoe sole to foot pedals of bicycles.

3 Claims, 3 Drawing Sheets

BICYCLE SHOE SOLE HAVING COUPLING MEMBER

BACKGROUND OF THE INVENTION

1. Field of the Invention

The present invention relates to a bicycle shoe sole, and more particularly to a bicycle shoe sole having a coupling member integrally formed or provided thereon, without additional fasteners, to allow the coupling member to be solidly disposed or attached on the bicycle shoe sole.

2. Description of the Prior Art

Typical bicycle shoes comprise a coupling member attached to the bottom portion thereof, for attaching onto corresponding coupling member that is disposed or secured on the foot pedals of the bicycles, and for securing or coupling the shoe to the foot pedals of the bicycles, and for preventing the bicycle shoe from being disengaged from the foot pedals of the bicycles inadvertently, particularly while riding the bicycles.

For example, U.S. Pat. No. 550,409 to Hanson discloses one of the typical bicycle shoes comprising a coupling member attached to the bottom portion thereof and having a number of radial arms extended therefrom, for engaging with and for coupling or securing to the bicycle foot pedals. Normally, the coupling member is made of solid metal or plastic materials, and is required to be secured to the bottom of the shoe with fasteners or rivets or the like.

Similarly, U.S. Pat. No. 4,876,808 to Hsieh discloses another typical bicycle shoe also comprising a coupling member attached to the bottom portion thereof, for engaging with and for coupling or securing to the bicycle foot pedals. The coupling member is also made of solid metal or plastic materials, and is required to be secured to the bottom of the shoe with fasteners or rivets or the like.

The typical bicycle shoes is normally made of rubber or plastic materials and includes a relatively smaller thickness for allowing the users to suitably step or pedal the bicycle foot pedals. However, the rubber or plastic materials are normally weak and may be easily broken or damaged such that the fasteners or rivets may not be used to solidly attach or couple the coupling members to the bicycle shoes.

In addition, normally, only the fasteners or rivets are coupled between the coupling members and the bicycle shoes, such that the bicycle shoes may be easily bent or twisted or tilted relative to the foot pedals of the bicycles, and such that the coupling members may also be easily disengaged from the bicycle shoes. Furthermore, after the coupling members are disengaged from the bicycle shoes, the bicycle shoes may be broken and water may easily flow into the bicycle shoes.

The present invention has arisen to mitigate and/or obviate the afore-described disadvantages of the conventional bicycle shoes for foot pedals of bicycles.

SUMMARY OF THE INVENTION

The primary objective of the present invention is to provide a bicycle shoe sole including a coupling member integrally formed or provided thereon, without additional fasteners or the like, to allow the coupling member to be solidly disposed or attached on the bicycle shoe sole.

In accordance with one aspect of the invention, there is provided a bicycle shoe sole comprising a bottom portion including a plurality of projections extended downwardly from an outer peripheral portion thereof, and including a middle portion having no projections extended therefrom, and including a stud extended downwardly from the middle portion thereof, and a coupling member integrally formed on the stud, without fasteners, to allow the coupling member to be solidly disposed and attached on the bicycle shoe sole, the coupling member including a front protrusion and a rear protrusion formed thereon, for coupling the shoe sole to foot pedals of bicycles.

The coupling member includes at least one side protrusion extended therefrom, and coupled to some of the projection. The shoe sole includes a resilient insert or a soft insert engaged therein.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
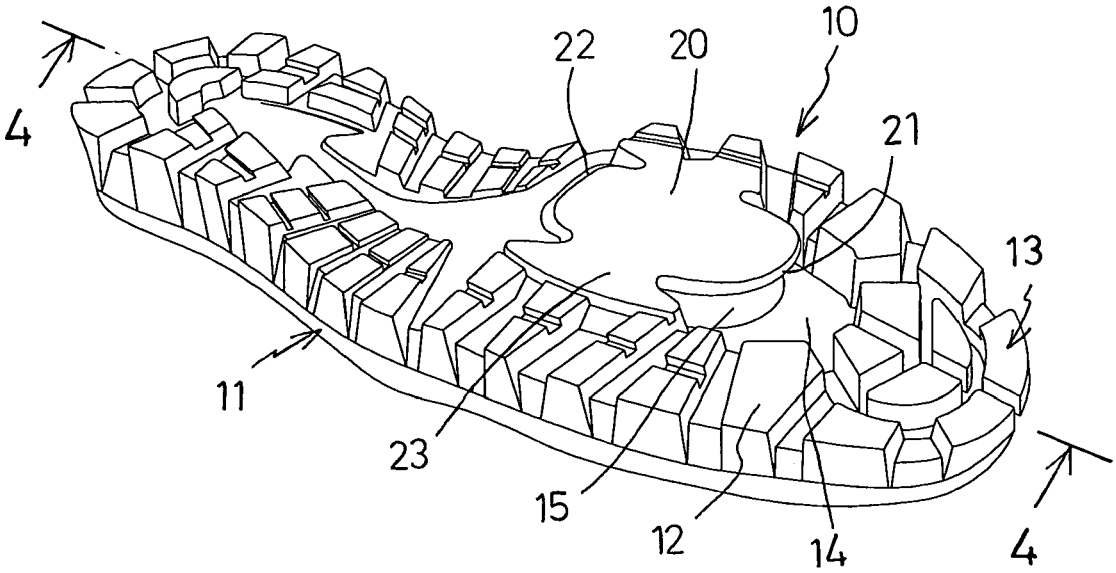
FIG. 1 is a bottom perspective view of a bicycle shoe sole in accordance with the present invention.

Referring to the drawings, and initially to FIGS. 1-4, a bicycle shoe sole 10 in accordance with the present invention comprises a bottom portion 11 including a number of bulges or swellings or projections 12 extended downwardly from an outer peripheral portion 13 thereof, and including an intermediate or middle portion 14 having no bulges or swellings or projections 12 extended therefrom, but having a stud 15 extended downwardly therefrom.

The bicycle shoe sole 10 further includes a coupling member 20 integrally formed or provided on the stud 15 with such as molding or mold injection processes, to allow the coupling member 20 to be solidly disposed or attached on the bicycle shoe sole 10 without additional fasteners. The coupling member includes a front protrusion 21 and a rear protrusion 22 formed thereon or extended therefrom, best shown in FIGS. 4 and 5, for securing or coupling the shoe sole 10 to the foot pedals of the bicycles (not shown).

Figure 2:
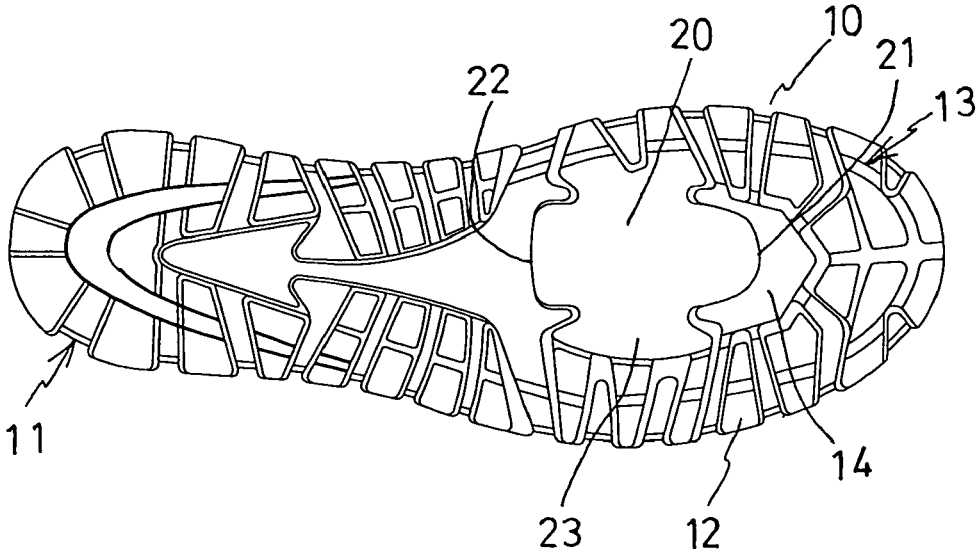
FIG. 2 is a bottom plan view of the bicycle shoe sole.
Figure 6:
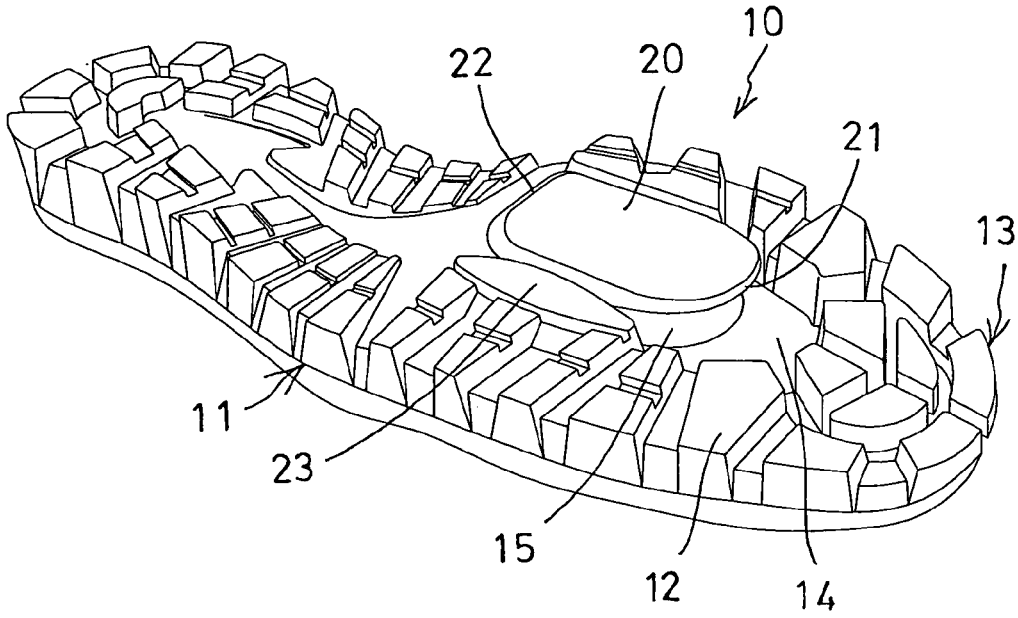
FIG. 6 is a perspective view similar to FIG. 1, illustrating the other embodiment of the bicycle shoe sole.
Figure 7:
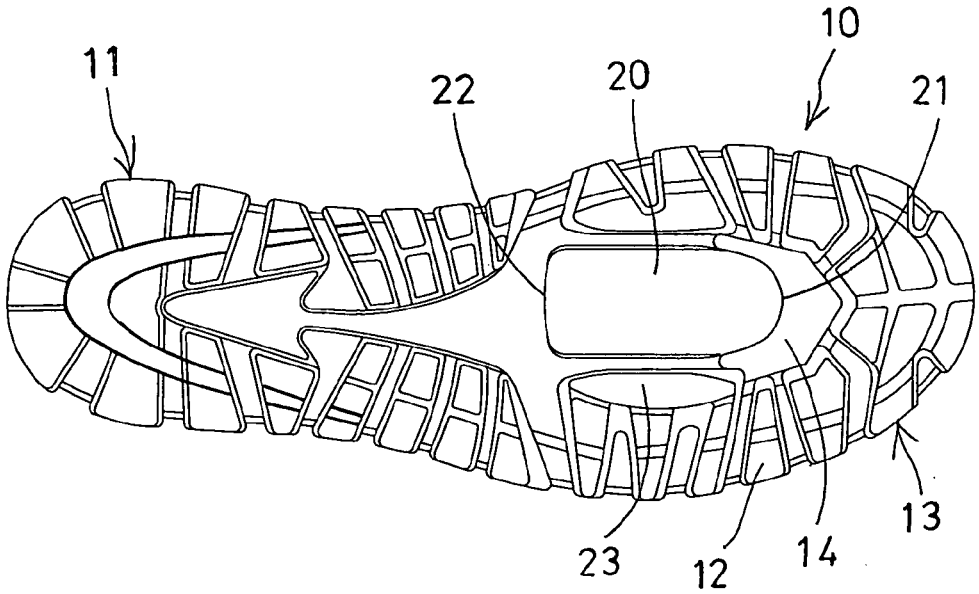
FIG. 7 is a bottom plan view of the bicycle shoe sole as shown in FIG. 6.

It is preferable that the coupling member 20 includes two side protrusions 23 formed thereon or extended therefrom, and solidly coupled to or formed integral with some of the projections 12, as shown in FIGS. 1 and 2, for allowing the coupling member 20 to further be solidly secured or coupled to the shoe sole 10. Alternatively, as shown in FIGS. 6 and 7, the side protrusions 23 of the coupling member 20 may also be separated from the projections 12.

It is to be noted that the stud 15 and the coupling member 20 are solidly secured or coupled to the shoe sole 10 with such as molding or mold injection processes, to allow the coupling member 20 to have a great coupling area formed and provided between the coupling member 20 and the shoe sole 10, and thus to allow the coupling member 20 to be solidly disposed or attached or secured on the bicycle shoe sole 10 without additional fasteners.

Figure 4:
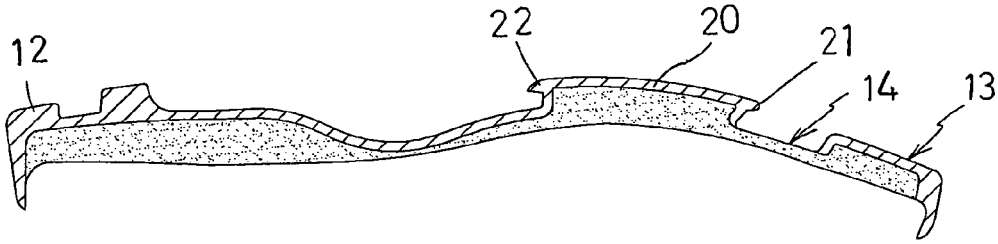
FIG. 4 is a cross sectional view of the bicycle shoe sole, taken along lines 4-4 of FIG. 1.
Figure 3:
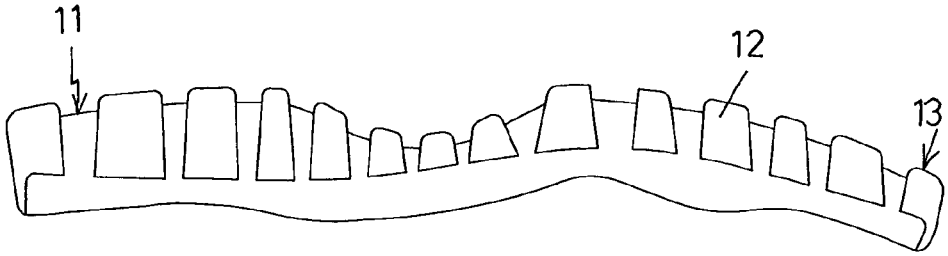
FIG. 3 is a side plan view of the bicycle shoe sole.
Figure 5:
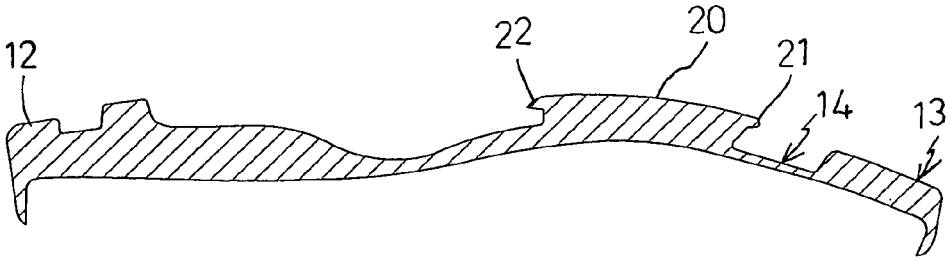
FIG. 5 is a cross sectional view similar to FIG. 4, illustrating the other arrangement of the bicycle shoe sole.

As shown in FIG. 4, because the stud 15 and the coupling member 20 are solidly secured or coupled to the shoe sole 10 with such as molding or mold injection processes, the shoe sole 10 may include a soft or resilient insert 24 engaged therein, without influence the coupling between the coupling member 20 and the shoe sole 10. Of course, the shoe sole 10 may also include a solid structure as shown in FIG. 5, without the soft or resilient insert 24 engaged therein.

Accordingly, the bicycle shoe sole in accordance with the present invention includes a coupling member integrally formed or provided thereon, without additional fasteners or the like, to allow the coupling member to be solidly disposed or attached on the bicycle shoe sole.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

We claim:

1. A bicycle shoe sole comprising: a bottom portion including a plurality of projections extended downwardly from an outer peripheral portion thereof, and including a middle portion having no projections extended therefrom, and including a stud extended downwardly from said middle portion thereof, and a coupling member integrally formed on said stud, without fasteners, to allow said coupling member to be solidly disposed and attached on said bicycle shoe sole, said coupling member including a front protrusion and a rear protrusion formed thereon, for coupling said shoe sole to foot pedals of bicycles; and wherein said coupling member includes at least one side protrusion extended therefrom, and coupled to some of said projection.

2. The bicycle shoe sole as claimed in claim 1, wherein said shoe sole includes a resilient insert engaged therein.

3. The bicycle shoe sole as claimed in claim 1, wherein said shoe sole includes a soft insert engaged therein.

* * * * *